US006644999B1

(12) United States Patent
Tan et al.

(10) Patent No.: US 6,644,999 B1
(45) **Date of Patent: *Nov. 11, 2003**

(54) CONNECTOR HAVING A CABLE THAT IS RELATIVELY MOVEABLE ABOUT AN AXIS

(75) Inventors: Tang Yew Tan, Palo Alto, CA (US); Richard P. Howarth, San Francisco, CA (US); Lawrence A. Barham, San Jose, CA (US); Gregory L. Tice, Los Altos, CA (US); Steven G. Siefert, Belmont, CA (US); Donald J. Novotney, Santa Clara, CA (US)

(73) Assignee: Apple Computer, Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/025,269

(22) Filed: Dec. 18, 2001

Related U.S. Application Data

(63) Continuation of application No. 09/628,198, filed on Jul. 28, 2000, now Pat. No. 6,338,645.

(51) Int. Cl.[7] ..... H01R 13/56
(52) U.S. Cl. ..... 439/446
(58) Field of Search ..... 439/468, 731, 439/610, 445, 447, 777, 446

(56) References Cited

U.S. PATENT DOCUMENTS

| | | | | |
|---|---|---|---|---|
| 2,530,540 A | | 11/1950 | Reichold et al. | |
| 2,756,402 A | | 7/1956 | Haworth et al. | |
| 4,564,255 A | * | 1/1986 | Kirma | 439/471 |
| 4,629,276 A | | 12/1986 | Genaro et al. | |
| 4,708,663 A | | 11/1987 | Eckart | |
| RE32,760 E | | 10/1988 | Chandler et al. | |
| 4,863,396 A | * | 9/1989 | Johnson | 439/470 |
| 5,138,678 A | | 8/1992 | Briggs et al. | |
| 5,324,209 A | | 6/1994 | Falossi et al. | |
| 6,338,645 B1 | * | 1/2002 | Tan et al. | 439/446 |
| 6,475,021 B1 | * | 11/2002 | Tan et al. | 439/446 |

FOREIGN PATENT DOCUMENTS

| | | |
|---|---|---|
| EP | 0558250 A1 | 9/1993 |
| EP | 0818854 A1 | 1/1998 |

OTHER PUBLICATIONS

PCT Search Report dated Jan. 22, 2002, 5 pages.

* cited by examiner

*Primary Examiner*—Lynn D. Feild
*Assistant Examiner*—Phuong K Dinh
(74) *Attorney, Agent, or Firm*—Blakely, Sokoloff, Taylor & Zafman LLP

(57) ABSTRACT

The invention includes a cable assembly housing. The cable assembly housing may include a main shell that defines a first cavity. The main shell may have a collar. The cable assembly may also include a cable shell that defines a second cavity. The cable shell may have a neck disposed between a mating surface and a flange. The flange of the cable shell may be disposed through the collar and inside the first cavity.

20 Claims, 6 Drawing Sheets

CONNECTOR HAVING A CABLE THAT IS RELATIVELY MOVEABLE ABOUT AN AXIS

RELATED APPLICATIONS

This is a continuation of application Ser. No. 09/628,198, now U.S. Pat. No. 6,338,645 filed on Jul. 28, 2000.

BACKGROUND OF THE INVENTION

1. Field of the Invention

The invention may include interrelated electrical connectors that are relatively movable about an axis.

2. Background Information

A personal computer system may be thought of as a general-purpose, single-user microcomputer that is designed to be operated by one person at a time. As small, low cost computer, a personal computer (PC) may include a monitor connected to a computer, each of which may receive power from an ordinary outlet. In operation, the monitor accepts video signals from a graphics card within the computer over a cable assembly and displays this information on a screen.

A monitor generally is designed to sit on an ordinary office desk. In some office arrangements, the computer is disposed directly below the monitor wherein the computer itself resides on the office desk. Here, this low profile computer is referred to as a desktop computer that is part of a desktop personal computer system configuration. In another office arrangement, the computer stands upright on the floor with the cabling running to a monitor, where the monitor itself sits directly on the office desk. In this set up, the computer is referred to a stand alone computer that is part of a stand alone personal computer system configuration.

In both the desktop configuration and the stand alone configuration, the cable assembly includes a cable that is attached to a connector. The connector is usually a seventeen to twenty four pin connector that is plugged into the graphics card. The low profile desktop configuration may require the that the connector be at a ninety degree angle to the axis of the cable whereas the stand alone configuration may require that the connector be at a different orientation with respect to the axis of the cable. However, for economic and other reasons, it may be desirable to be able to use the same cable assembly design for both the desktop configuration and the stand alone configuration. Accordingly, it may be desirable to have a cable assembly where the connector is relatively moveable about an axis of the cable.

SUMMARY OF THE INVENTION

The invention includes a cable assembly housing. The cable assembly housing may include a main shell that defines a first cavity. The main shell may have a collar. The cable assembly may also include a cable shell that defines a second cavity. The cable shell may have a neck disposed between a mating surface and a flange. The flange of the cable shell may be disposed through the collar and inside the first cavity.

DETAILED DESCRIPTION OF THE INVENTION

Figure 1A:
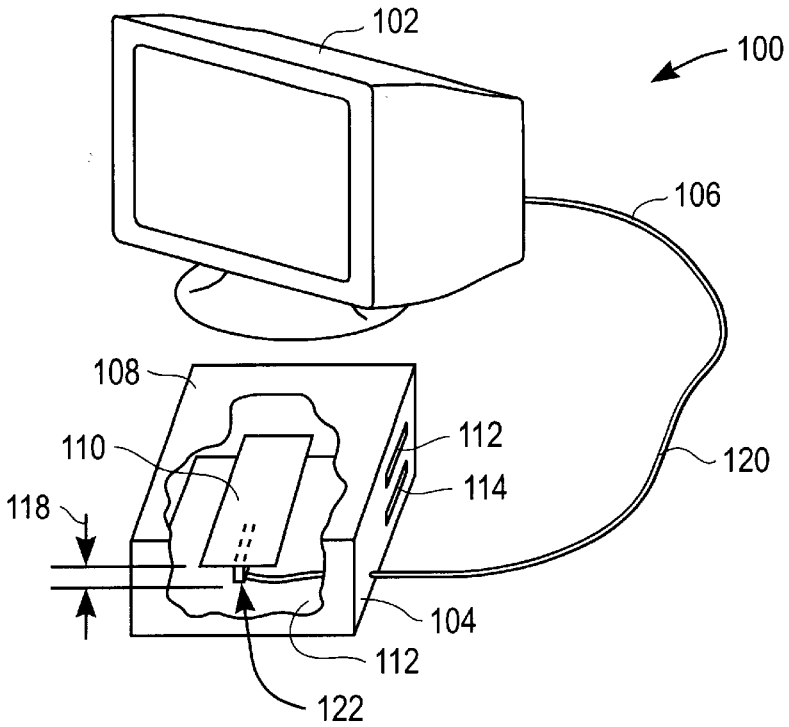
FIG. 1A illustrates personal computer system 100 in a desktop configuration.

FIG. 1A illustrates personal computer system 100 in a desktop configuration. Included with personal computer (PC) system 100 may be monitor 102, desktop computer 104, and cable assembly 106. Monitor 102 may be a cathode-ray tube and associated electronics connected to a video output of desktop computer 104. Desktop computer 104 may be any machine that can be programmed to manipulate symbols.

Included with desktop 104 may be chassis 108 having graphics card 110 disposed therein. Chassis also may have Small Computer System Interface (SCSI) slot 112 and Peripheral Component Interconnect (PCI) slot 114 located as shown. Each of SCSI slot 112 and PCI slot 114 may provide an input/output port for connection of external devices.

Graphics card 110 may be a circuit board fitted within chassis 108 that contains the necessary video memory and other electronics to provide a bitmap display. Graphics card 110 may have an output port (not shown) that faces bottom surface 112 of chassis 108. Distance 118 between graphics card 110 and bottom surface 112 may be a low profile distance, such as 60.0 millimeters (mm) (2.4 inches).

Cable assembly 106 may include cable 120 and connector 122. Cable 120 may be a bound or sheathed group of mutually insulated conductors. At one end, cable 120 may be attached to monitor 102. At the other end, cable 120 may be attached to connector 122 as discussed in connection with FIG. 2.

Connector 122 may be any pin to socket connector. At the open mating end of connector 122, connector 122 may be attached to graphics card 110 as shown in FIG. 1A. As a result of the low profile stretch of distance 118, connector 122 may be required to be at an angle with respect to an axis of cable 120 where the angle formed is less than 180.0 degrees.

Figure 1B:
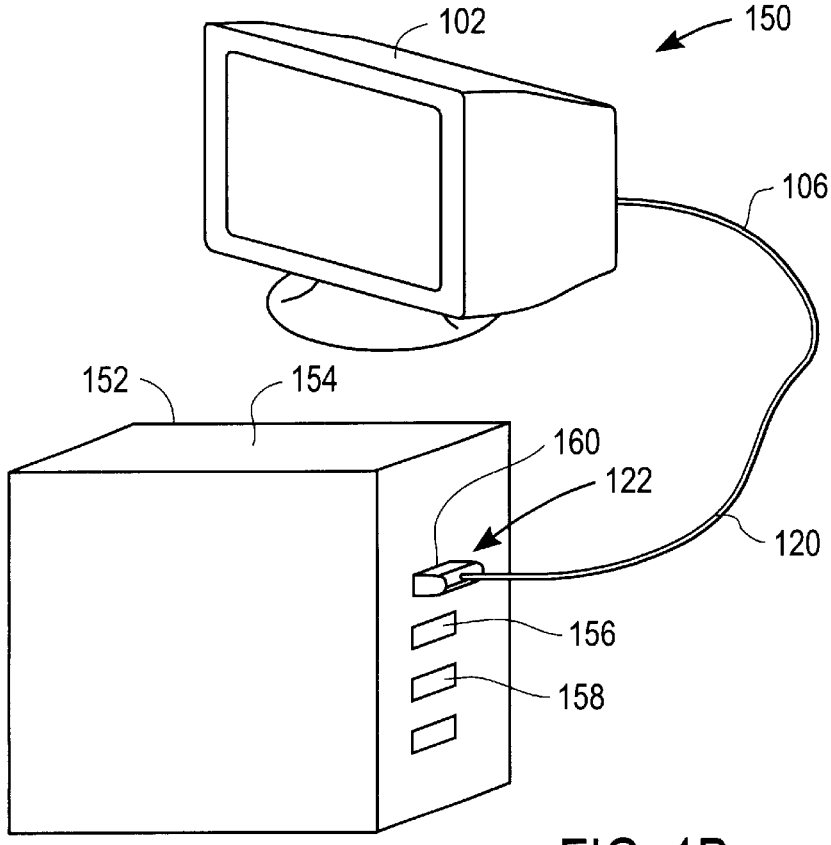
FIG. 1B illustrates personal computer system 150 in a stand alone configuration.

FIG. 1B illustrates personal computer system 150 in a stand alone configuration. Included with PC system 150 may be monitor 102, stand alone computer 152, and cable assembly 106. Stand alone computer 152 may include chassis 154 having SCSI slot 156 and PCI slot 158 disposed below video port 160. Video port 160 may be attached to graphics card 110 (not shown in FIG. 1B).

At the open mating end of connector 122, connector 122 may be attached to video port 160. To avoid interference with SCSI slot 156 and PCI slot 158 by cable 120, connector 122 may be required to be at an angle with respect to an axis of cable 120. Here, cable 120 may be viewed as being dressed straight out from connector 122 or rotated with respect to the long axis of connector 122.

Figure 2:
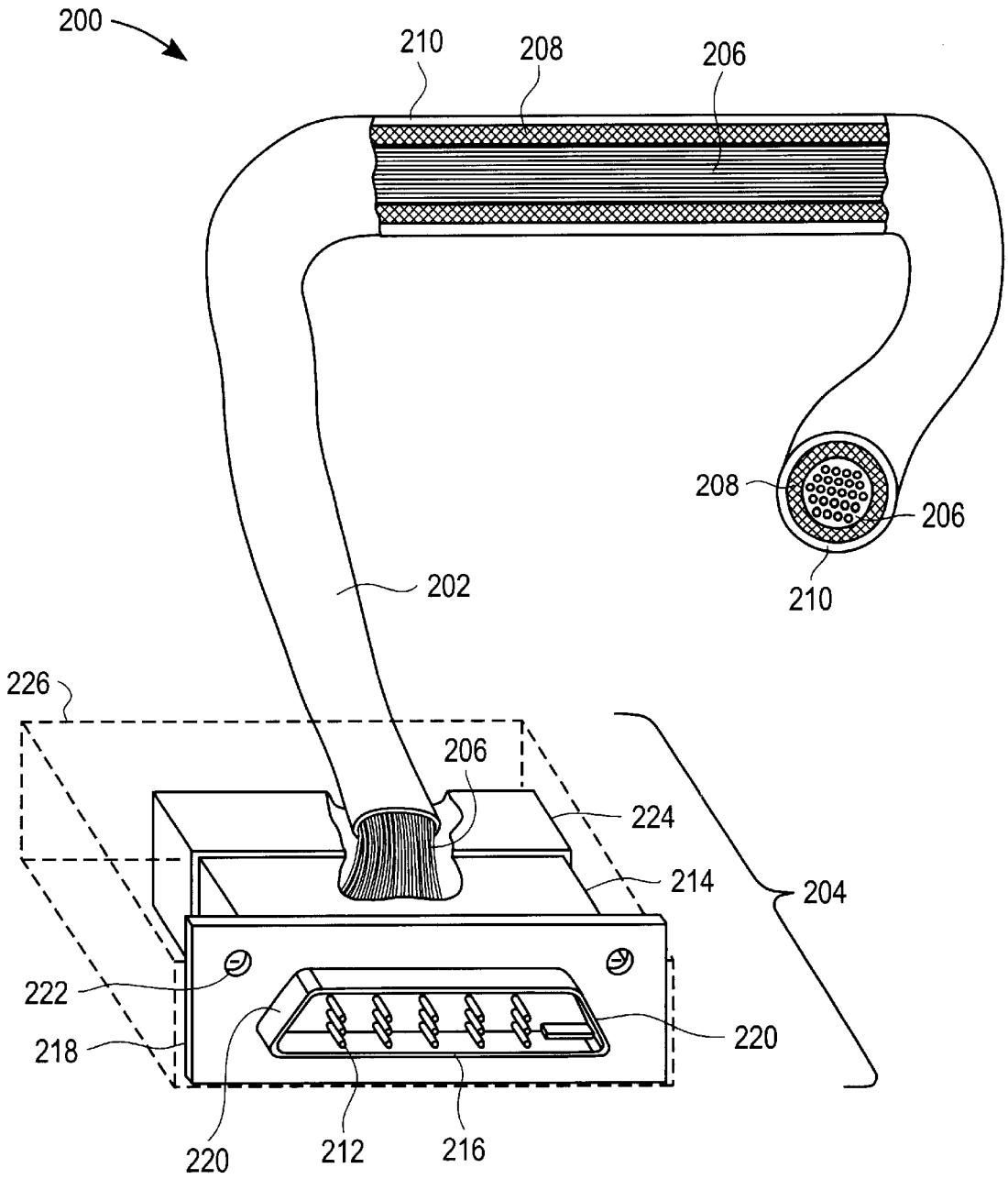
FIG. 2 illustrates cable assembly 200.

FIG. 2 illustrates cable assembly 200. Cable assembly 106 of FIG. 1A and FIG. 1B may be based on cable assembly 200. Cable assembly 200 may be thought of as a plug and display (P&D) cable assembly.

Cable assembly 200 may include cable 202 and connector 204. Cable 202 may include wires 206, shield 208, and jacket 210. Each of wires 206 may be a metallic strand or rod that is electrically insulated so as to safely conduct electricity. Although there may be any number of wires 206, in one embodiment, the number of wires 206 ranges from seventeen to twenty four.

Electricity traveling through each wire 206 may generate an electromagnetic field. Where not curbed, this electromagnetic field may interfere with video images, such as those appearing on monitor 102 of FIG. 1A. In one embodiment, shield 208 may be disposed about wires 206. Shield 208 may be metallic strand that are braided into a tube shape so as to confine any electromagnetic field generated by wires 206 within the interior of shield 208. Shield 208 may serve as a ground conductor. Moreover, jacket 210 may be disposed about shield 208 as an insulator.

Connector 204 may include posts 212, cover 214, shell 216, and flange 218. posts 212 may provide an electrical pathway between wires 206 and, for example, graphics card 110 of FIG. 1A. Posts 212 may either be male or female pins that are supported by flange 218. Each wire 206 may be connected to an assigned post 212 within cover 214. Cover 214 may serve to enclose wires 206 as well as the connection point between wires 206 and posts 212.

Shell 216 may include keys 220 and be mounted against flange 218 so as to enclose the mating ends of posts 212. Along with keys 220, shell 216 may provide orientation and insertion guidance of connector 204 with respect to graphics card 110. In this capacity, flange 218 may serve to limit the insertion of connector 204 into an input/output of graphics card 110. Where flange 218 includes mounting holes 222, screws may be disposed through mounting holes 222 and into chassis 154 or graphics card 110 so as to secure connector 204 to a structure.

Where wires 206 exit from jacket 210 and enter cover 214, the electromagnetic field caused from these wires 206 may be free to interfere with local electronics. To work to prevent this, connector 204 may further include Electromagnetic Interference (EMI) shield 224. As a metal structure, EMI shield 224 may provide a seal between jacket 210 and EMI shield 224.

Disposed about connector 204 and portions of cable 202 may be housing 226. Housing 226 is discussed in connection with the remainder of the figures. Connector 204 and cable 202 may be thought of as interrelated electrical connectors. In this sense, housing 226 may permit relatively movement between connector 204 and cable 202 so that cable assembly 200 may serve as cable assembly 106 of FIG. 1A and FIG. 1B.

Figure 3:
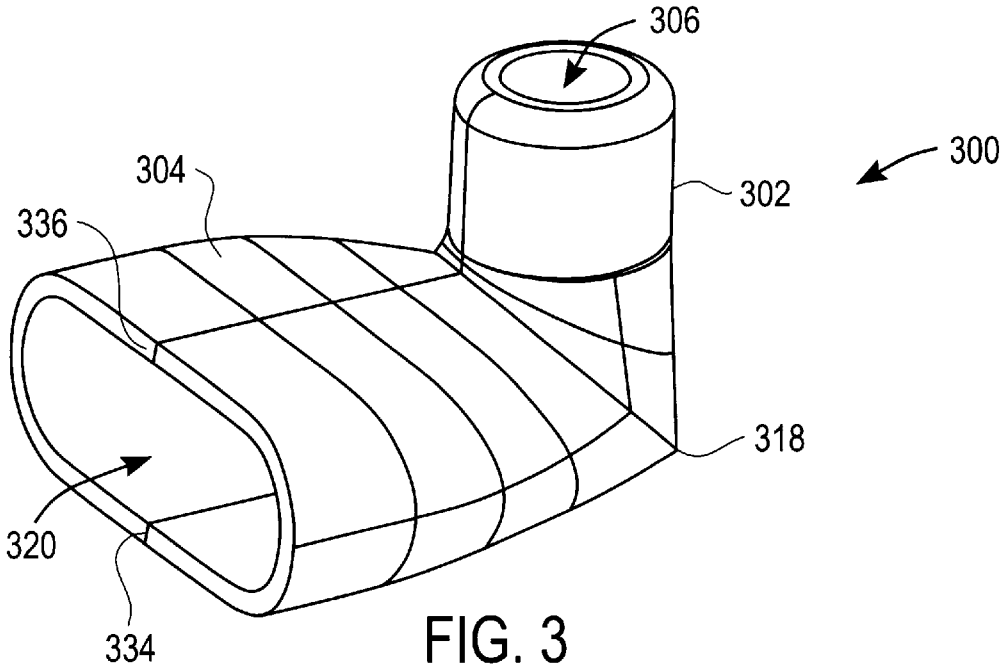
FIG. 3 illustrates housing 300 of the invention.
Figure 4:
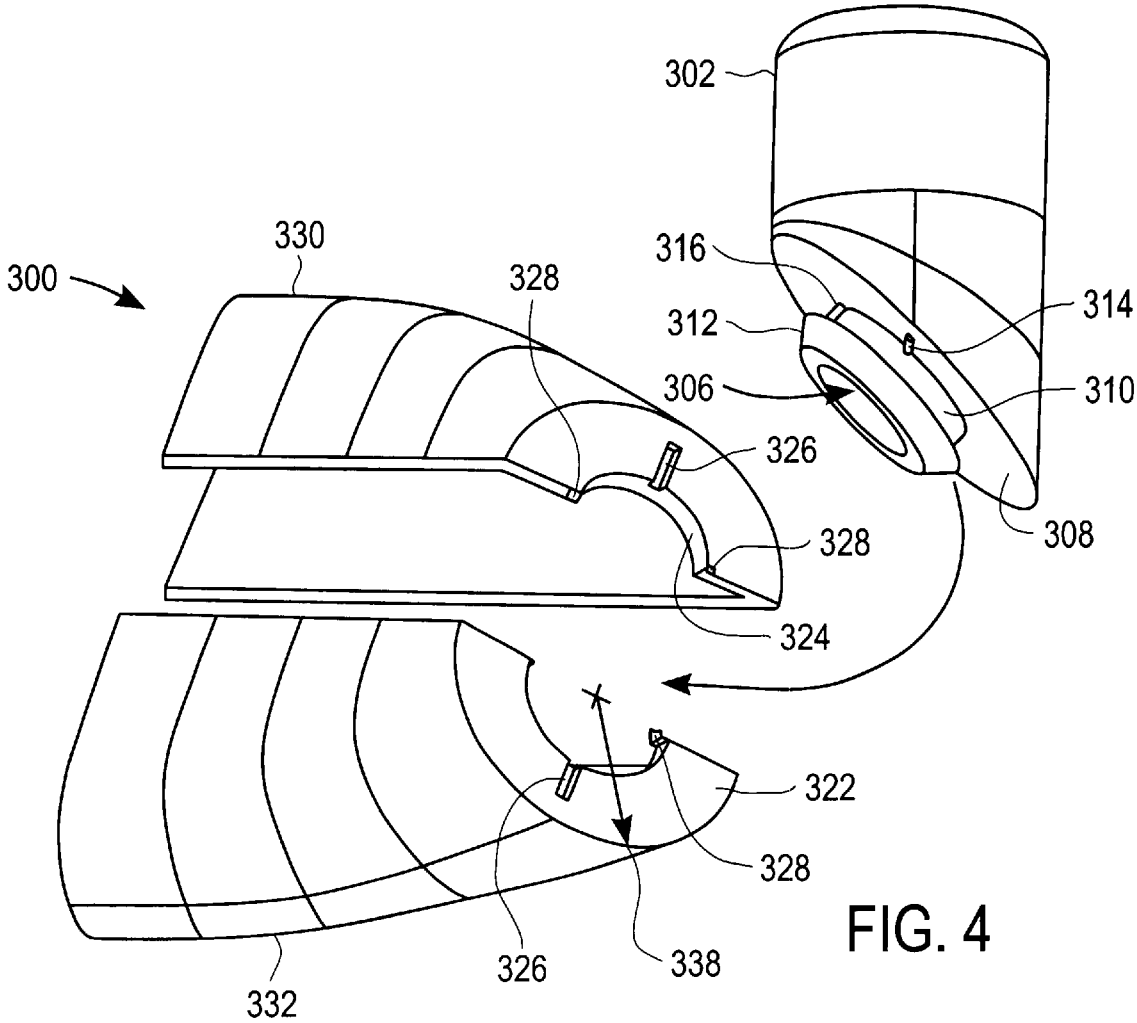
FIG. 4 illustrates an exploded view of housing 300.

FIG. 3 illustrates housing 300 of the invention. FIG. 4 illustrates an exploded view of housing 300. Housing 300 may include cable shell 302 and main shell 304.

Cable shell 302 may have interior material removed to form cavity 306. Cable shell 302 may also include mating surface 308, neck 310, flange 312, detents 314, and key 316.

Cavity 306 may be a hollow area within the body of cable shell 302 that permits wires, such as those of cable 202 (FIG. 2), to be disposed within and through cable shell 302. In one embodiment, cavity 306 includes a circular perimeter. Mating surface 308 may be an outer or topmost boundary of cable shell 302 that serves as one of a matched pair of surfaces that comes together at interface 318. Neck 310 may be a narrow ring that elevates flange 312 above mating surface 308 so as to form a protruding rim. With its protruding, tapered rim, flange 312 may be used to hold cable shell 302 against main shell 304 as well as provide clearance for wires 206.

Each detent 314 may serve as a catch or lever that locks the rotational movement of cable shell 302 relative to main shell 304. In one embodiment, a plurality of detents 314 may extend radially outward from neck 310 along mating surface 308. Each key 316 may extend radially outward from neck 310 between mating surface 308 and flange 312 at a predetermined angle from a detent so as to provide a limit on the relative rotation between cable shell 302 and main shell 304. This may prevent over twisting wires 206.

Main shell 304 may have interior material removed to form cavity 320. Main shell 304 may also include mating surface 322, collar 324, slots 326, and stops 328.

In one embodiment, main shell 304 is formed in a single piece where collar 324 designed to slip over flange 312. However, if main shell 304 may slip over flange 312, main shell 304 may slip away from flange 312 by reversing the process. In an alternate embodiment, main shell 304 includes first shell piece 330 and second shell piece 332.

Cavity 320 may be a hollow area within the body of main shell 304 that permits wires and a connector, such as those of cable 202 (FIG. 2), to be disposed at least one of within and through main shell 304. In one embodiment, cavity 320 defines an oblong perimeter that tailors into a circular perimeter. Mating surface 322 may be an outer or topmost boundary of main shell 304 that serves as one of a matched pair of surfaces that comes together at interface 318. Collar 324 may be an inwardly extending ring that forms an open space having a diameter that is large enough to surround neck 310 and that is small enough to be restrained between flange 312 and mating surface 308.

Each slot 326 may be a narrow indentation into mating surface 322 that accepts one detent 314 at a predetermined orientation between cable shell 302 and main shell 304. Each stop 328 may extend radially inward from collar 324 at a predetermined angle from a slot 326. Where cable shell 302 is coupled to main shell 304, stops 328 may meet keys 316 at a given rotation to provide a limit on the relative rotation between cable shell 302 and main shell 304. In one embodiment each stop 328 is arranged ninety degrees from a slot 326.

To assemble housing 300, first shell piece 330 may be brought into contact with second shell piece 332 with flange 312 disposed within cavity 320. First shell piece 330 then may be brought secured to second shell piece 332 along seam 334 and seam 336 such as by sonic welding or by applying adhesives. With main shell 304 formed, mating surface 322 of main shell 304 may meet mating surface 308 of cable shell 302 at interface 318.

In one embodiment, main shell 304 may rotate ninety degrees relative to cable shell 302. To prevent one mating surface from extending beyond the other mating surface at interface 318, each mating surface may include a circular perimeter. Where radius 338 of mating surface 332 equals the radius of mating surface 308, neither mating surface will extend beyond the other mating surface at interface 318 regardless of the relative orientation between main shell 304 and cable shell 302.

Figure 5:
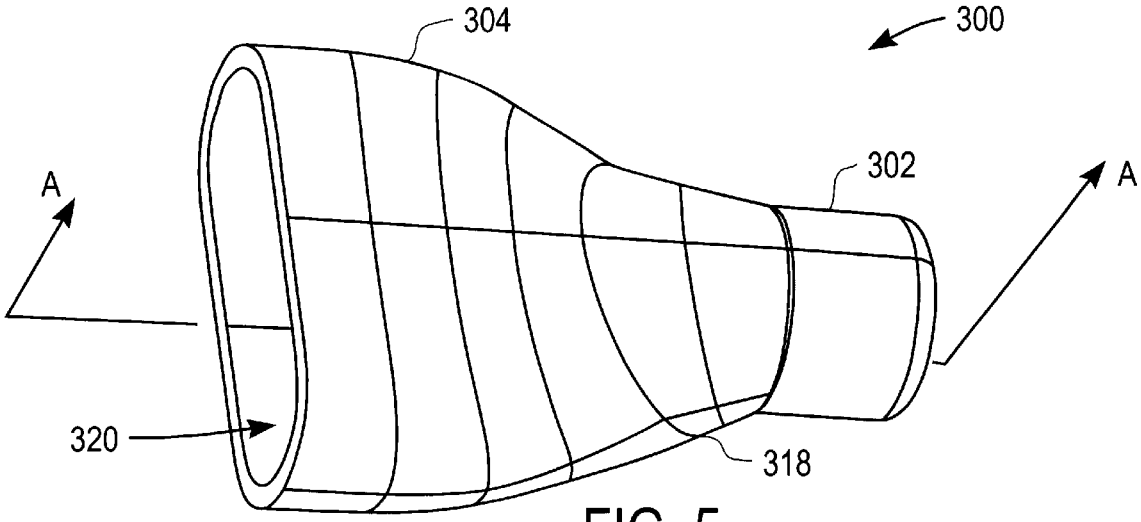
FIG. 5 illustrates main shell 304 at a one hundred eighty degree orientation to cable shell 302.

FIG. 3 displays main shell 304 at a ninety degree orientation to cable shell 302. Such an orientation may be sufficient to employ in personal computer system 100 of FIG. 1A. FIG. 5 illustrates main shell 304 at a one hundred eighty degree orientation to cable shell 302. Such an orientation may be sufficient to employ in personal computer system 150 of FIG. 1B.

Figure 5A:
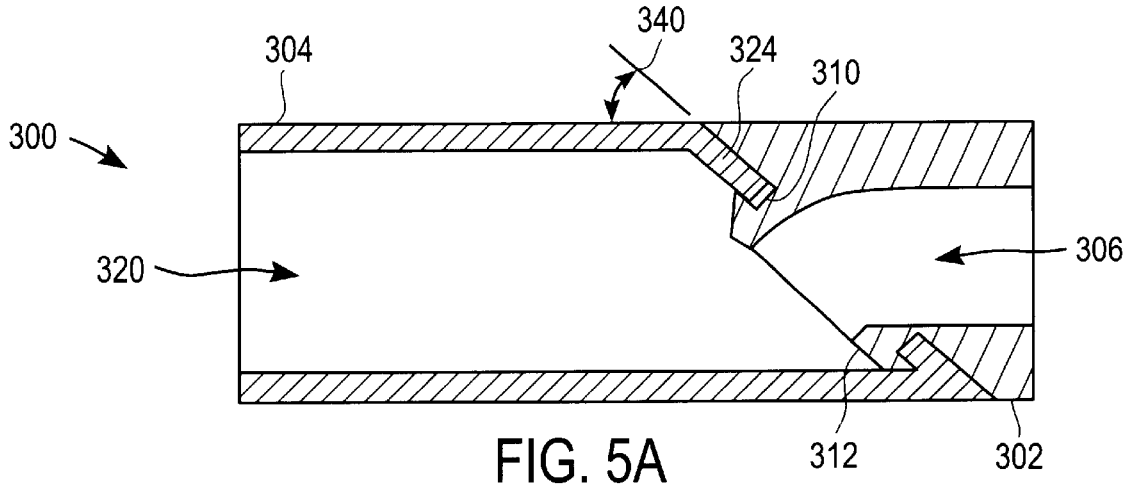
FIG. 5A is a cross sectional view of housing 300 taken generally off of line A—A of FIG. 5.
Figure 5B:
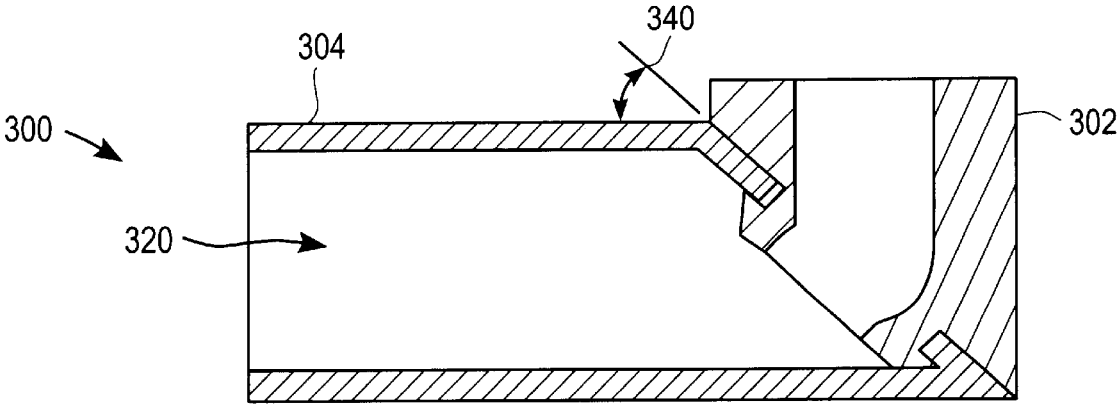

FIG. 5A is a cross sectional view of housing 300 taken generally off of line A—A of FIG. 5. FIG. 5B illustrates a second position of cable shell 302 with respect to main shell 304. Interface 318 may define angle 340. Angle 340 may affect the possible orientations between cable shell 302 and main shell 304. In one embodiment, angle 340 is forty five degrees.

Cable shell 302 may be made from any thermoplastic that presents a high-impact strength, such as a polycarbonate. Galling is a process where similar material rubbing surfaces are damaged by friction and abrasion. Accordingly, main shell 304 may be made of any material that is different or dissimilar from cable shell 302. This may work to minimize galling. In one embodiment, main shell 304 includes acrylonitrile butadiene styrene (ABS), such as in polycarbonate ABS (PC/ABS). Where first shell piece 330 is ultrasonically welded to second shell piece 332, cable shell 302 may be made of a material that resists the heat of this ultrasonic welding process.

To assemble cable assembly 200 into housing 300, cable 202 may be disposed through cavity 306 and cavity 320. Connector 204 may then be attached to cable 202. Due to the movement of cable 202 with respect to connector 204, a rigid EMI shield 224 may cause damage to wires 206. In one embodiment, a flexible EMI shield 224 may be disposed at the juncture between wires 206 and posts 212 so as to act as a strain relief that relieves axial stress. Flexible EMI shield 224 may be disposed within adhesives, such as paste, mucilage, glue, or epoxy.

Figure 6:
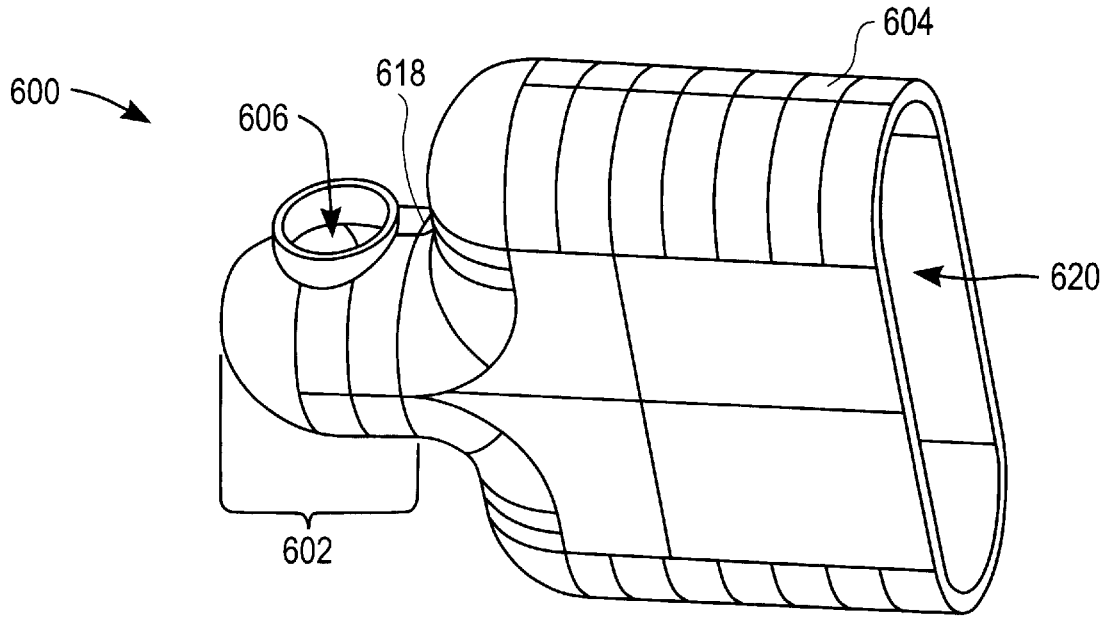
FIG. 6 illustrates housing 600 of the invention.
Figure 7:
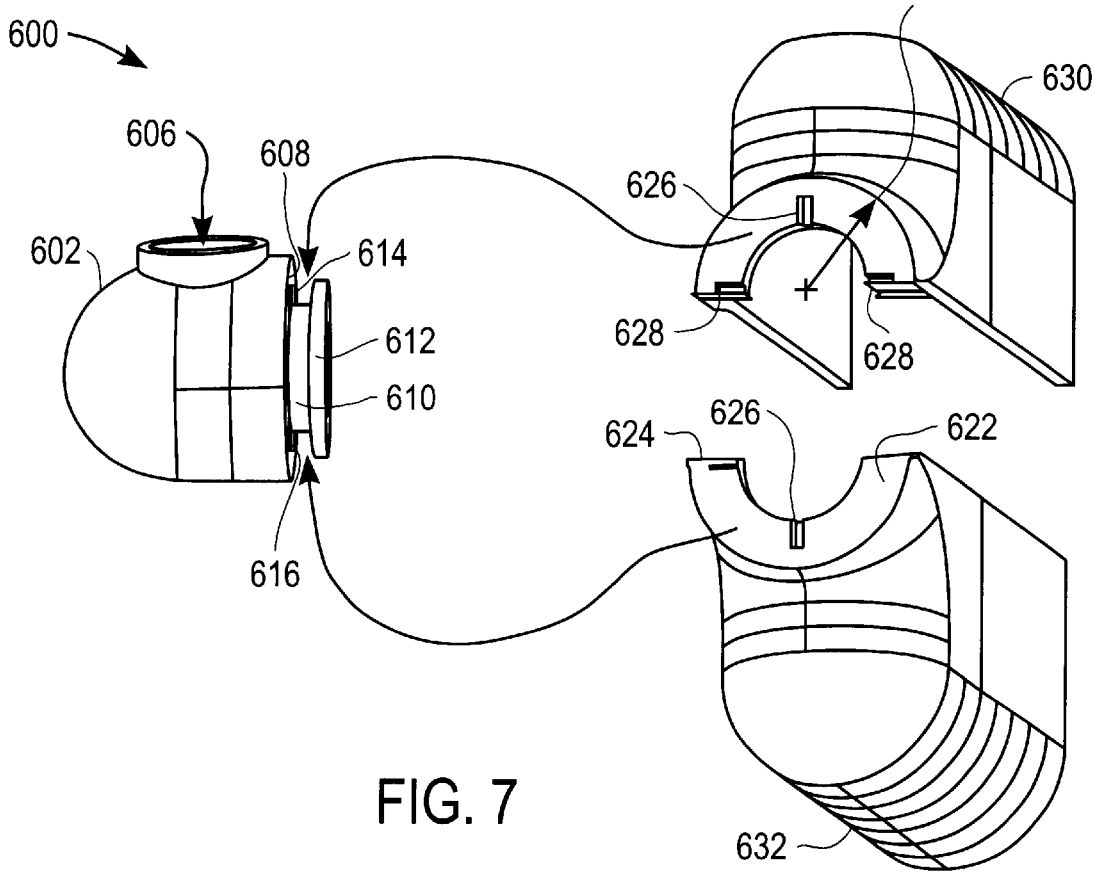
FIG. 7 illustrates an exploded view of housing 600.

FIG. 6 illustrates housing 600 of the invention. FIG. 7 illustrates an exploded view of housing 600. Housing 600 may include cable shell 602 and main shell 604.

Cable shell 602 may have interior material removed to form cavity 606. Cable shell 602 may also include mating surface 608, neck 610, flange 612, and detent 614, and detent 616.

Cavity 606 may be a hollow area within the body of cable shell 602 that permits wires, such as those of cable 202 (FIG. 2), to be disposed within and through cable shell 602. Mating surface 608 may be an outer or topmost boundary of cable shell 602 that serves as one of a matched pair of surfaces that comes together at interface 618. Neck 610 may be a narrow ring that elevates flange 612 above mating surface 608 so as to form a protruding rim. With its protruding rim, flange 612 may be used to hold cable shell 602 against main shell 604.

Detent 614 and detent 616 may serve as a catch or lever that locks the rotational movement of cable shell 602 relative to main shell 604. Each detent may extend radially outward from neck 610 along mating surface 608.

Main shell 604 may have interior material removed to form cavity 620. Main shell 604 may also include mating surface 622, collar 624, slots 626, and slots 628.

In one embodiment, main shell 604 is formed in a single piece where collar 624 designed to slip over flange 612. However, if main shell 604 may slip over flange 612, main shell 604 may slip away from flange 612 by reversing the process. In an alternate embodiment, main shell 604 includes first shell piece 630 and second shell piece 632.

Cavity 620 may be a hollow area within the body of main shell 604 that permits wires and a connector, such as those of cable 202 (FIG. 2), to be disposed at least one of within and through main shell 604. In one embodiment, cavity 620 defines an oblong perimeter that tailors into a circular perimeter. Mating surface 622 may be an outer or topmost boundary of main shell 604 that serves as one of a matched pair of surfaces that comes together at interface 618. Collar 624 may be an inwardly extending ring that forms an open space having a diameter that is large enough to surround neck 610 and that is small enough to be restrained between flange 612 and mating surface 608.

Each slot 626 and 628 may be a narrow indentation into mating surface 622 that accepts one detent at a predetermined orientation between cable shell 602 and main shell 604. In one embodiment, each slot 626 is arranged ninety degrees from a slot 628.

To assemble housing 600, first shell piece 630 may be brought into contact with second shell piece 632 with flange 612 disposed within cavity 620. First shell piece 630 then may be brought secured to second shell piece 632 along seam 634 and seam 636 such as by sonic welding or by applying adhesives. With main shell 604 formed, mating surface 622 of main shell 604 may meet mating surface 608 of cable shell 602 at interface 618.

Figure 8:
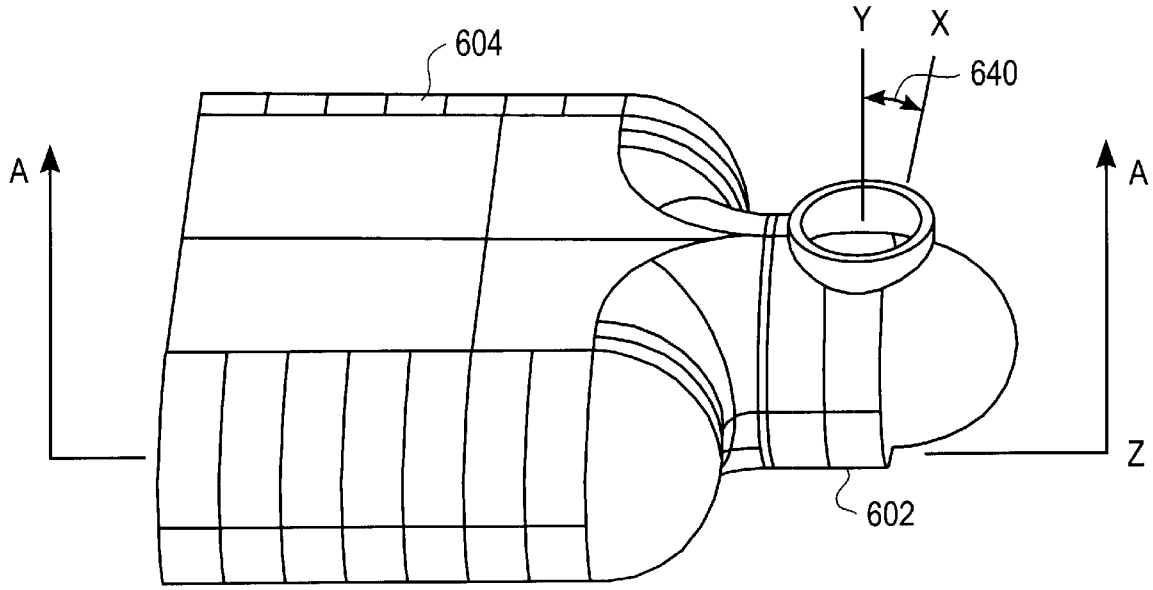
FIG. 8 illustrates main shell 604 at a different ninety degree orientation to cable shell 602.
Figure 8A:
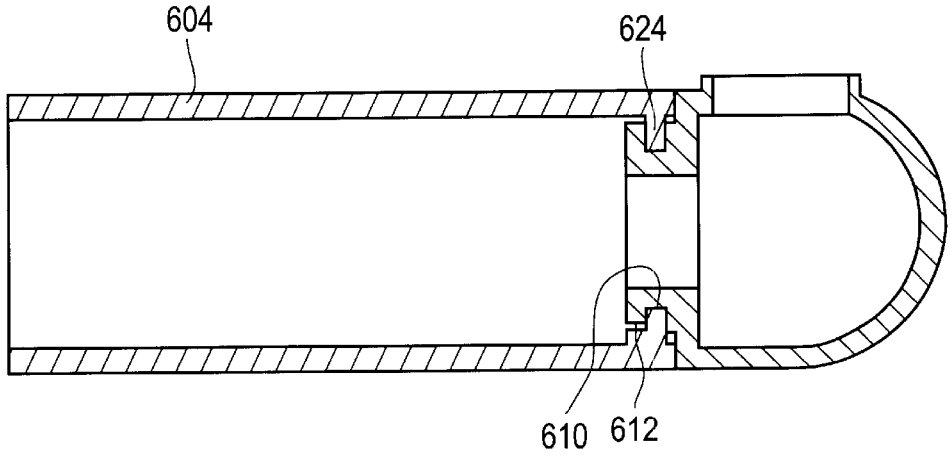
FIG. 8A is a cross sectional view of housing 600 taken generally off of line A—A of FIG. 8.

FIG. 6 displays main shell 604 at a ninety degree orientation to cable shell 602. Such an orientation may be sufficient to employ in personal computer system 100 of FIG. 1A where the long axis (XZ plane) of connector 122 runs along the long axis (YZ plane) of cable 120. Alternatively, FIG. 8 illustrates main shell 604 at a different ninety degree orientation to cable shell 602. FIG. 8A is a cross sectional view of housing 600 taken generally off of line A—A of FIG. 8.

The orientation illustrated in FIG. 8 may be sufficient to employ in personal computer system 150 of FIG. 1A where the long axis (XZ plane) of connector 122 is ninety degrees to the long axis (YZ plane) of cable 120. Angle 640 may be defined as the divergence between the XZ plane and the YZ plane. Angle 640 may range between zero and one hundred eighty degrees. In one embodiment, angle 640 ranges between zero and ninety degrees. Here, housing 600 may permit cable 120 of FIG. 1B to be rotated with respect to the long axis of connector 122.

The exemplary embodiments described herein are provided merely to illustrate the principles of the invention and should not be construed as limiting the scope of the subject matter of the terms of the claimed invention. The specification and drawings are, accordingly, to be regarded in an illustrative rather than a restrictive sense. Moreover, the principles of the invention may be applied to achieve the advantages described herein and to achieve other advantages or to satisfy other objectives, as well.

What is claimed is:

1. A cable assembly housing comprising:

a main shell that defines a first cavity, the main shell having a collar; and a cable shell that defines a second cavity, the cable shell having a neck disposed between a mating surface and a flange, wherein the flange is disposed through the collar and inside the first cavity, and wherein the cable shell is relatively moveable about an axis of the main shell.

2. The cable assembly housing of claim 1 wherein the main shell collar includes a mating surface that is at a forty five degree angle to an axis of the main shell cavity and wherein the cable shell mating surface is at a forty five degree angle to an axis of the cable shell cavity.

3. The cable assembly housing of claim 2 wherein each mating surface defines a perimeter and wherein each mating surface perimeter is circular.

4. The cable assembly housing of claim 3 wherein the main shell includes a first shell piece coupled to a second shell piece.

5. The cable assembly housing of claim 1 wherein the main shell collar includes a mating surface that is at a ninety degree angle to an axis of the main shell cavity and wherein the cable shell mating surface is parallel to an axis of the cable shell cavity.

6. The cable assembly housing of claim 5 wherein each mating surface defines a perimeter and wherein each mating surface perimeter is circular.

7. The cable assembly housing of claim 6 wherein the main shell includes a first shell piece coupled to a second shell piece.

8. A cable assembly comprising:

a cable having a plurality of wires disposed within shield, wherein the shield is disposed within a jacket;

a connector having a plurality of posts coupled to a cover, the connector further having a shell disposed about the posts, wherein each wire is coupled to a post to form a juncture;

a flexible electromagnetic interference shield disposed over and between each juncture and the cover;

a main shell that defines a first cavity, the main shell having a collar wherein the connector is disposed in the first cavity and the cable is disposed through the collar; and a cable shell that defines a second cavity, the cable shell having a neck disposed between a mating surface and a flange, wherein the flange is disposed through the collar and inside the first cavity, and wherein the cable is disposed through the second cavity, and wherein the cable shell is relatively moveable about an axis of the main shell.

9. The cable assembly of claim 8 wherein the main shell collar includes a mating surface that is at a forty five degree angle to an axis of the main shell cavity and wherein the cable shell mating surface is at a forty five degree angle to an axis of the cable shell cavity.

10. The cable assembly of claim 9 wherein each mating surface defines a perimeter and wherein each mating surface perimeter is circular.

11. The cable assembly of claim 10 wherein the main shell includes a first shell piece coupled to a second shell piece.

12. The cable assembly of claim 8 wherein the main shell collar includes a mating surface that is at a ninety degree angle to an axis of the main shell cavity and wherein the cable shell mating surface is parallel to an axis of the cable shell cavity.

13. The cable assembly of claim 12 wherein each mating surface defines a perimeter and wherein each mating surface perimeter is circular and wherein the main shell includes a first shell piece coupled to a second shell piece.

14. A cable assembly housing comprising:

a main shell that defines a first cavity, the main shell having a collar and including a first shell piece coupled to a second shell piece, wherein the collar includes a first circular mating surface that is at a forty five degree angle to an axis of the first cavity, and wherein the first circular mating surface includes at least one slot defined into the collar from the first circular mating surface; and a cable shell that defines a second cavity, the cable shell having a neck disposed between a second circular mating surface and a flange, wherein the cable shell includes at least one detent that extends radially outward from the neck along the second circular mating surface, wherein the second circular mating surface is at a forty five degree angle to an axis of the second cavity and at a forty five degree angle to an axis of the first cavity, and wherein the flange is disposed through the collar and inside the first cavity.

15. The cable assembly housing of claim 14 wherein the at least one slot is two slots that share a common centerline and wherein the at least one detent is two detents that share a common centerline.

16. The cable assembly housing of claim 15 wherein the main shell collar includes two stops, wherein each stop extends radially inward from the collar at a predetermined angle from a slot and wherein the cable shell includes two keys, wherein each key extends radially outward from the neck between the cable shell mating surface and the flange at a predetermined angle from a detent.

17. The cable assembly housing of claim 16 wherein each predetermined angle is ninety degrees.

18. A cable assembly housing comprising:

a main shell that defines a first cavity, the main shell having a collar and including a first shell piece coupled to a second shell piece, wherein the collar includes a first circular mating surface that is at a ninety degree angle to an axis of the main shell cavity and wherein the first circular mating surface includes at least one slot defined into the collar from the first circular mating surface; and a cable shell that defines a second cavity, the cable shell having a neck disposed between a second circular mating surface and a flange, wherein the cable shell includes at least one detent that extends radially outward from the neck along the second circular mating surface and wherein the second circular mating surface is parallel to an axis of the second cavity, and wherein the flange is disposed through the collar and inside the first cavity.

19. The cable assembly housing of claim 18 wherein the at least one slot is four slots, wherein each slot is orientated at a ninety degree angle to an adjacent slot, wherein the at least one detent is four detents, and wherein each detent is orientated at the ninety degree angle to an adjacent detent.

20. The cable assembly housing of claim 19 wherein the main shell cavity defines an oblong perimeter that tailors into a circular perimeter.

* * * * *